US007008039B2

(12) United States Patent
Yamazaki

(10) Patent No.: US 7,008,039 B2
(45) Date of Patent: Mar. 7, 2006

(54) WIPER FOR CLEANING JETTING HEAD AND LIQUID JETTING APPARATUS EQUIPPED THEREWITH

(75) Inventor: Takeshi Yamazaki, Hachioji (JP)

(73) Assignee: Konica Corporation, (JP)

( * ) Notice: Subject to any disclaimer, the term of this patent is extended or adjusted under 35 U.S.C. 154(b) by 191 days.

(21) Appl. No.: 10/667,914

(22) Filed: Sep. 22, 2003

(65) Prior Publication Data

US 2004/0061737 A1 Apr. 1, 2004

(30) Foreign Application Priority Data

Sep. 27, 2002 (JP) ..... 2002-284056

(51) Int. Cl.
*B41J 2/165* (2006.01)

(52) U.S. Cl. ..... 347/33; 347/23

(58) Field of Classification Search ..... 347/22, 347/29, 33, 5, 19, 23, 30, 35; 399/350
See application file for complete search history.

(56) References Cited

U.S. PATENT DOCUMENTS 6,056,387 A * 5/2000 Kaneko ..... 347/23

FOREIGN PATENT DOCUMENTS

| | | |
|---|---|---|
| JP | 05-201013 | 8/1993 |
| JP | 06-316063 | 11/1994 |
| JP | 2003-165232 | 6/2003 |

* cited by examiner

*Primary Examiner*—Shih-Wen Hsieh
(74) *Attorney, Agent, or Firm*—Cantor Colburn LLP

(57) ABSTRACT

An ink jet printer having therein a controller including a warning function to warn a user of deterioration of a cleaning wiper for a jetting head, the cleaning wiper rubbing a jetting plane of the jetting head having the jetting plane on which a jetting port for jetting liquid to be jetted is provided, and thereby removing jetted liquid sticking to the jetting plane.

4 Claims, 7 Drawing Sheets

WIPER FOR CLEANING JETTING HEAD AND LIQUID JETTING APPARATUS EQUIPPED THEREWITH

BACKGROUND OF THE INVENTION

The present invention relates to a cleaning wiper for a jetting head that removes jetted liquid sticking to a jetting plane of the jetting head and to a liquid jetting apparatus.

Heretofore, for example, with respect to jetting head 2 in an ink jet printer equipped with a liquid jetting apparatus, a plurality of jetting ports 22 each jetting ink as a drop are provided on jetting plane 2*a*. The jetting head 2 is usually maintained at an interval of recording images in the prescribed number. To be concrete, for eliminating clogging caused by an increase of ink viscosity or by adherence of ink or clogging caused by air bubbles or dust generated in a flow path that leads to jetting port 22, the jetting plane 2*a* of the jetting head 2 is covered by suction cap 61A hermetically, and then, is drawn out by suction pump 64A through the suction cap 61A so that the aforementioned clogging may be eliminated.

Then, after completion of the suction stated above, the suction cap 61A is detached from the jetting plane 2*a* of the jetting head 2. In this case, as shown in FIG. 7(*b*), ink containing air bubbles tends to stick to the jetting plane 2*a*, and ink remains on the jetting plane 2*a*. If the ink is allowed to stay on the jetting plane 2*a*, clear images cannot be recorded on a recording medium. Therefore, there is known one wherein wiper member 63A having appropriate elasticity rubs the jetting plane 2*a* to remove ink staying on the jetting plane 2*a* after detachment of the suction cap 61A, as shown in FIG. 8 (for example, Japanese Patent No. 3232135).

However, if ink wettability for wiper member 63A is high and a contact angle is small when the wiper member 63A rubs the jetting plane 2*a* to remove ink staying on the jetting plane 2*a* as in Japanese Patent No. 3232135, the ink sometimes leaks from a slight clearance between the jetting plane 2*a* and the wiper member 63A, which means that ink that fails to be removed remains on the jetting plane 2*a*.

Further, in Japanese TOKKAI No. 2003-165232, the inventors of the present invention disclose an invention wherein a cleaning member that cleans an ink-jetting surface of a recording head is provided, and the cleaning member is made of an ink-repellent material having an angle of contact with ink of 50° or more. In this invention, however, there is no description about a warning to be sent out when the cleaning member is deteriorated.

There further is Japanese Patent No. 3255313 by the inventors of the present invention, in which the relationship between the number of times of cleaning operations performed the cleaning member and a life of the recording head. However, there is no description about necessity and frequency of replacement of recording heads based on the number of times of cleaning operations performed by the cleaning member.

SUMMARY OF THE INVENTION

An object of the invention is to provide a cleaning wiper capable of removing surely ink remaining on a jetting plane and to provide a liquid jetting apparatus.

The object stated above can be attained by either one of the following Structures (1)–(7).

Structure (1): An ink jet printer having therein a controller containing a warning function to warn a user of deterioration of a cleaning wiper for a jetting head, the cleaning wiper rubbing a jetting plane of a jetting head having the jetting plane on which a jetting port for jetting liquid to be jetted is provided, and thereby removing jetted liquid sticking to the jetting plane.

Structure (2): The ink jet printer according to Structure (1), wherein the backward dynamic contact angle of the present time is estimated based on the number of times of the conducted maintenance operations by reference to data obtained through measurement in advance (the number of times of maintenance operations versus backward dynamic contact angle), and the controller warns a user of the time of replacement for the cleaning wiper when the backward dynamic contact angle comes to a prescribed value or lower.

Structure (3): The ink jet printer according to Structure (1), wherein the controller warns a user of the time of replacement for the cleaning wiper by informing a user of the existing surface roughness or an amount of abrasion of the blade used in the cleaning wiper, based on the number of times of the maintenance operations.

Structure (4): The ink jet printer equipped with the cleaning wiper according to Structure (1), wherein the controller is provided with a measuring function for measuring a backward dynamic contact angle of a contact portion that comes in contact with the liquid jetting plane at the cleaning wiper, and the controller conducts warns in the prescribed output form when the backward dynamic contact angle of the contact portion measured by the backward dynamic contact angle measuring function is judged to be greater than the backward dynamic contact angle for judgment established in advance.

Structure (5): The ink jet printer according to Structure (2), wherein the backward dynamic contact angle formed between the cleaning wiper and jetted liquid is 50.5° or more.

Structure (6): The ink jet printer according to Structure (3), wherein a surface roughness (Ra) of the blade is 9 $\mu$m or less.

Structure (7): The ink jet printer according to Structure (4), wherein the backward dynamic contact angle formed between the cleaning wiper and jetted liquid is 50.5° or more.

Further, more preferable Structures (8) to (10) are as follows.

Structure (8): A cleaning wiper that comes in contact with a jetting plane of a jetting head having the jetting plane provided with a jetting port for jetting a liquid to be jetted, and cleans the jetting head by removing the jetted liquid sticking to the jetting plane, wherein a contact angle formed by the liquid jetted is not less than 50.5°.

In the invention according to Structure (8), a contact angle formed between the cleaning wiper for the jetting head that removes jetted liquid sticking to the jetting plane of the jetting head and jetted liquid is not less than 50.5°, and therefore, the jetted liquid to be removed by the cleaning wiper is removed from the jetting plane of a jetting head properly by the cleaning wiper without spreading its surface on face of the cleaning wiper. Thereby, the jetted liquid sticking to the jetting plane of the jetting head can be removed without remaining on the jetting plane of the jetting head.

Structure (9): The cleaning wiper for cleaning a jetting head described in structure (8), wherein the contact angle is a backward dynamic contact angle formed between the cleaning wiper and the jetted liquid.

In the invention according to Structure (9), the same effect as in the invention described in Structure (8) can naturally be obtained, and in particular, the jetted liquid to be removed by the cleaning wiper can be removed properly from the jetting plane of the jetting head by the cleaning wiper, without spreading the liquid surface on the rear portion in a movement of the cleaning wiper in cleaning operation, because a backward dynamic contact angle formed between the cleaning wiper that removes jetted liquid sticking to the jetting plane of the jetting head to clean the jetting head and jetted liquid is not less than 50.5°. It is therefore possible to remove jetted liquid sticking to the jetting plane of the jetting head without leaving the jetted liquid on the jetting plane of the jetting head.

Structure (10): A liquid jetting apparatus equipped with the cleaning wiper for cleaning the jetting head described in Structure (8) or Structure (9), wherein there are provided a surface roughness measuring means that measures surface roughness of a contact portion that comes in contact with the jetting plane in the cleaning wiper, a judgment means that judges whether or not the surface roughness value of the contact portion obtained through measurement by the roughness value measurement means is greater than the surface roughness for judgment established in advance, and a warning means that conducts warns in a described output format when the surface roughness value of the contact portion is judged to be greater than the surface roughness value for judgment by the judgment means.

In the invention according to Structure (10), it is possible to warn promptly that the surface roughness value of the contact portion has become greater than the surface roughness value for judgment, because the warning means warns in a prescribed output format when the surface roughness value of the contact portion of the wiper for cleaning measured by the roughness measuring means is judged to be greater than the surface roughness value for judgment established in advance by the judging means.

In other words, deterioration of the cleaning wiper that the surface roughness value of the contact portion has become greater than the surface roughness value for judgment established as a threshold value in advance can be warned promptly, and appropriate actions can be taken based on what has been warned.

Figure 7:
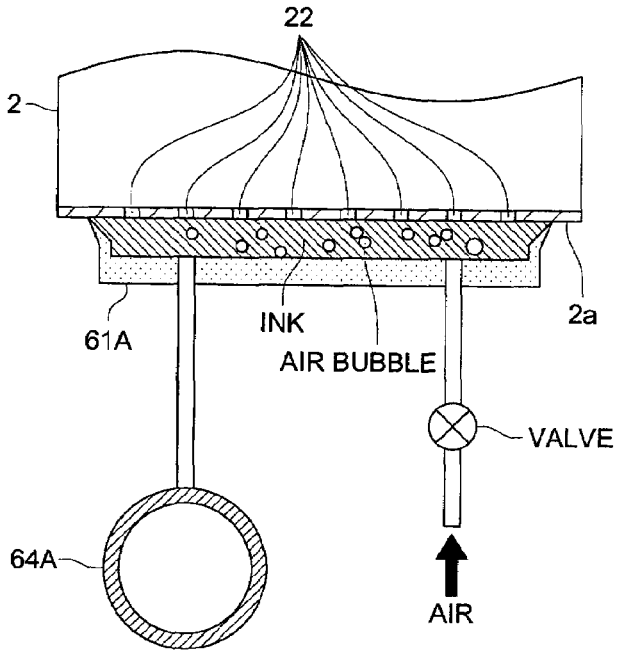
FIG. 7 (a) PRIOR ART
Figure 7:
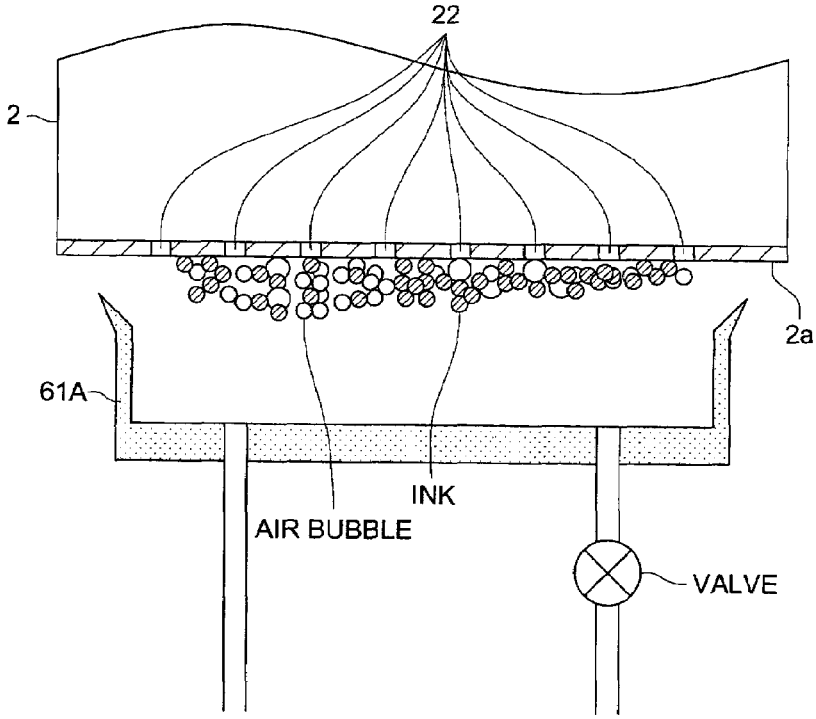
FIG. 7 (b) PRIOR ART

Each of FIGS. 7(*a*) and 7(*b*) is a partially-sectional side view showing how a jetting plane of a jetting head is maintained by a suction cap.

Figure 8:
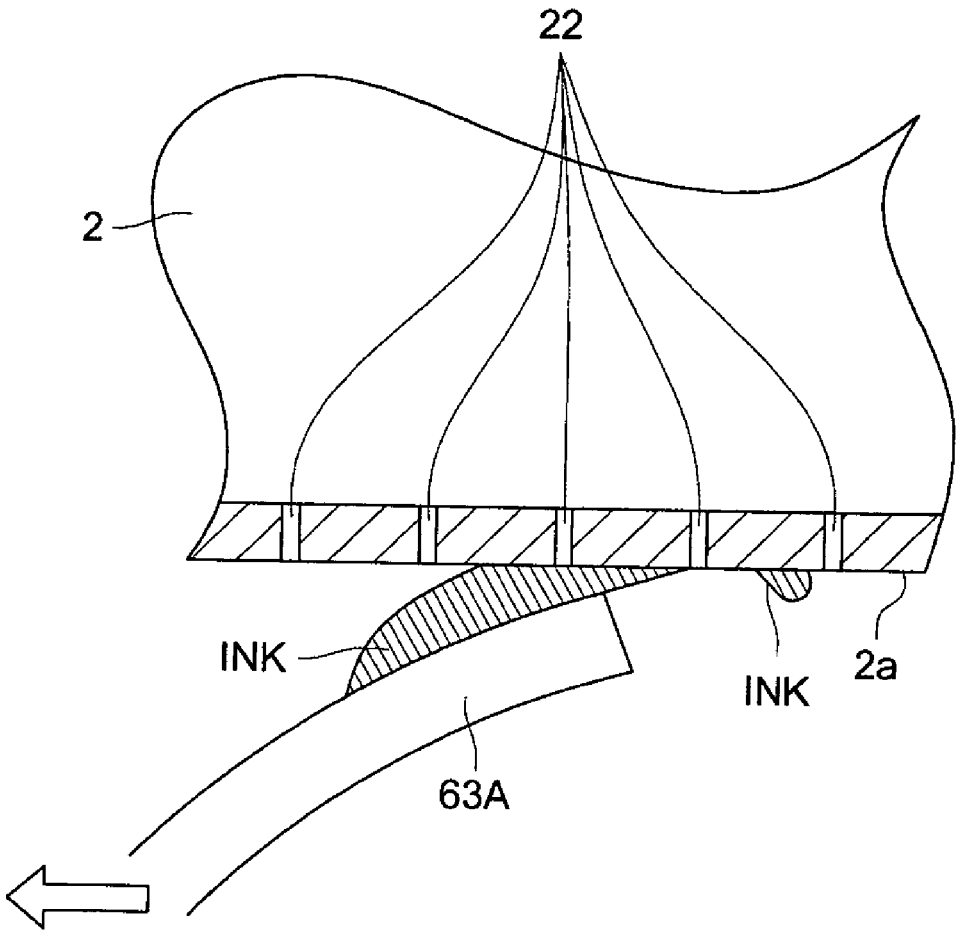
FIG. 8 PRIOR ART

FIG. 8 is a partially-sectional side view showing a wiper portion that cleans a jetting plane of a jetting head in a conventional ink jet printer.

DETAILED DESCRIPTION OF THE PREFERRED EMBODIMENT

An embodiment wherein a liquid jetting apparatus of the invention is applied to an ink jet printer will be explained in detail as follows, referring to the drawings.

Figure 1:
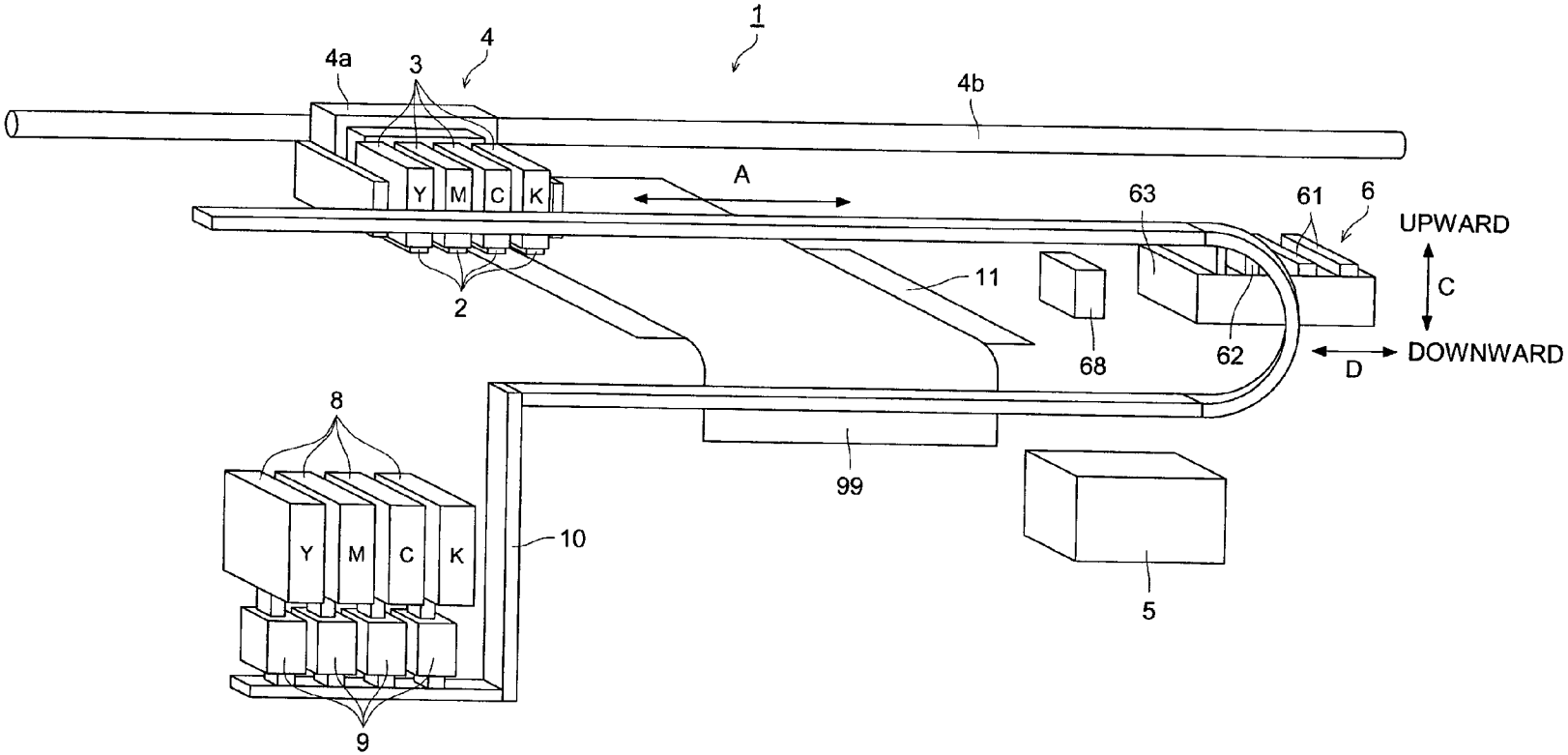
FIG. 1 is a perspective view showing the primary portions of an ink jet printer to which the invention is applied.
Figure 2:
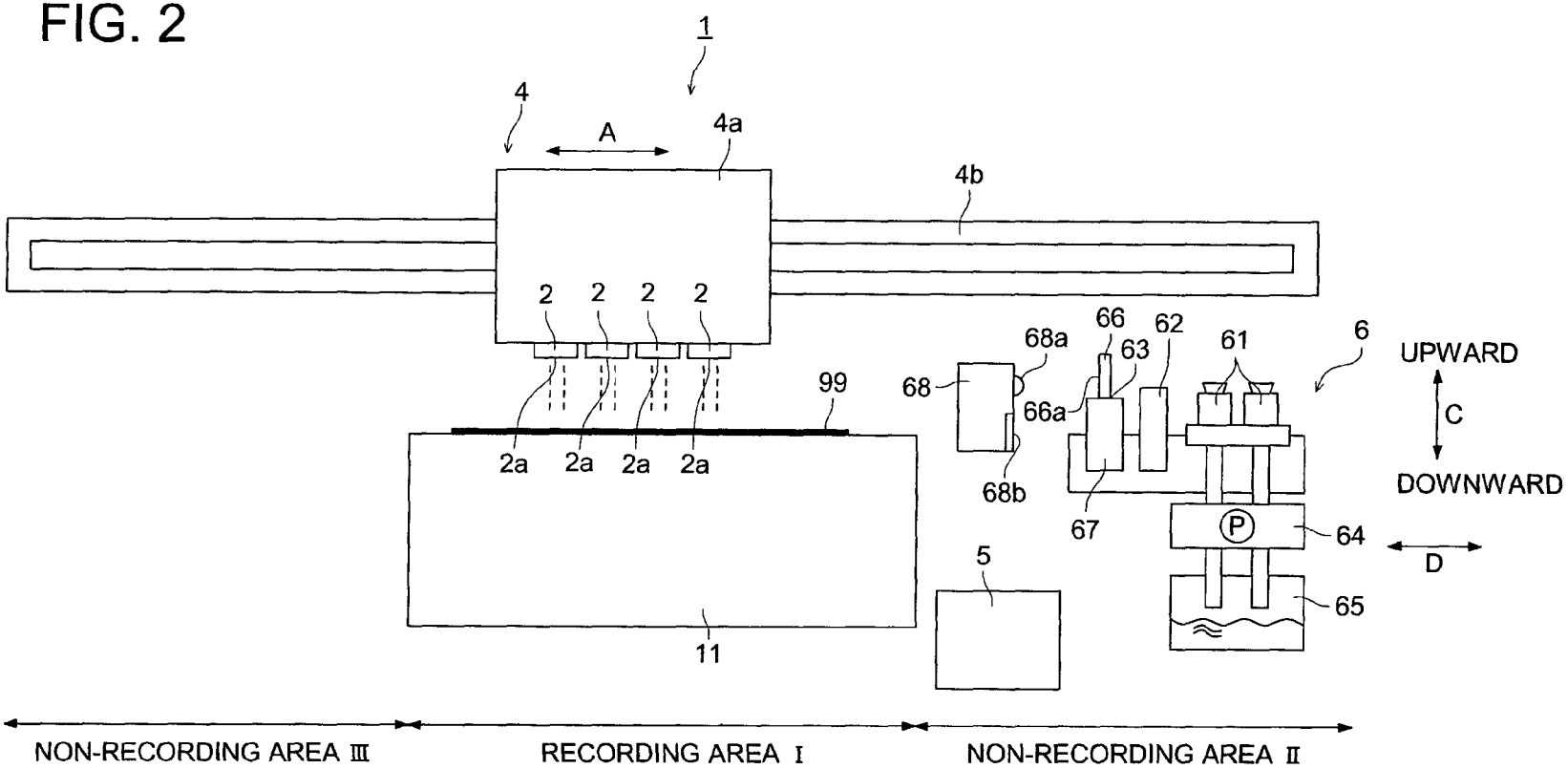
FIG. 2 is a partially-omitted front view showing a primary portion of an ink jet printer to which the invention is applied.

FIG. 1 is a perspective view showing primary portions of ink jet printer 1 of the invention. FIG. 2 is a partially-omitted front view of the ink jet printer 1.

As shown in FIG. 1 and FIG. 2, the ink jet printer 1 is provided with four jetting heads 2, 2, 2, 2 each jetting ink representing liquid to be jetted to recording medium 99, four sub-tanks 3, 3, 3, 3 each supplying ink to each jetting head 2, carriage 4*a* having jetting heads 2 and sub-tanks 3, and representing a liquid jetting apparatus movable in the main scanning direction A, maintenance unit 6 that conducts maintenance of each jetting head 2, four main tanks 8, 8, 8, 8 each reserving ink of each color, four pressure pumps 9, 9, 9, 9 each being connected to each main tank and supplying ink from each main tank 8 to each sub-tank 3, ink supplying member 10 conveying liquid from each main tank 8 to each sub-tank 3, platen 11 that holds non-recording surface of recording medium 99, and with control portion 5 that controls operations of each member of ink jet printer 1 including the aforementioned members.

Each of four jetting heads 2, 2, 2, 2 is connected with each of four sub-tanks 3, 3, 3, 3 respectively. These four jetting heads 2, 2, 2, 2 are housed in carriage 4*a* which will be described later together with the sub-tanks 3 and are carried by the carriage 4*a*. While the carriage 4*a* is moving, each jetting head 2 makes ink supplied from sub-tank 3 that is connected with the jetting head 2 to be a drop and jets it on a recording surface of recording medium 99.

Figure 3:
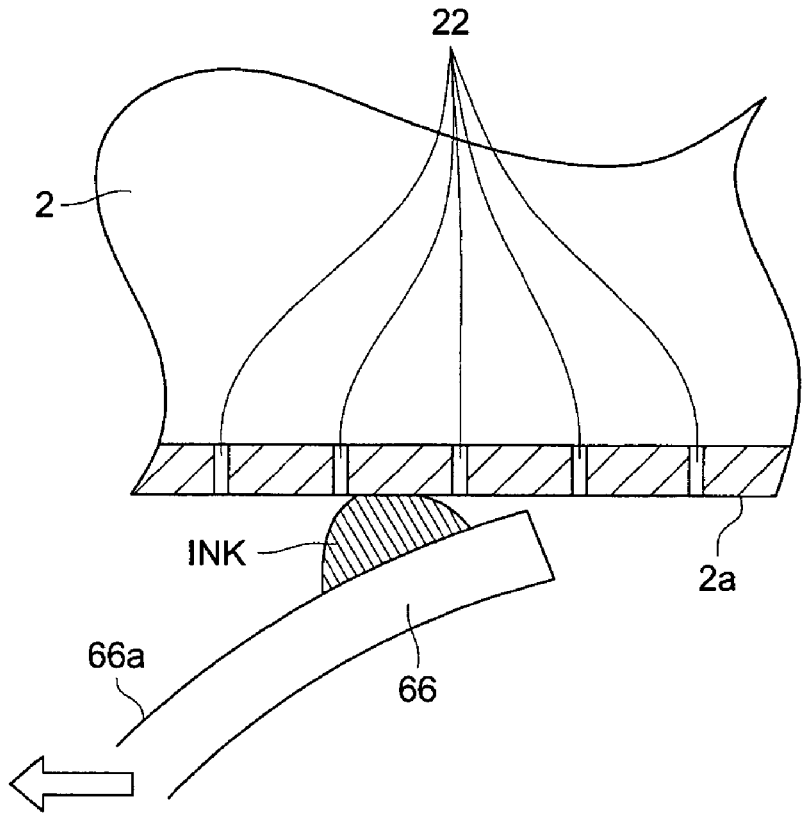
FIG. 3 is a partially-sectional side view showing a wiper portion that cleans a jetting plane of a jetting head in an ink jet printer to which the invention is applied.

Incidentally, on the lower face of each jetting head 2, there is formed jetting plane 2*a* on which a plurality of jetting ports 22 are provided as shown in FIG. 3 that will be described later, and ink is jetted on recording medium 99 from the jetting ports 22.

Carriage mechanism portion 4 is provided with carriage 4*a* that houses therein aforementioned four jetting heads 2, 2, 2, 2 and four sub-tanks 3, 3, 3, 3, guide member 4*b* that lies in main scanning direction A and guides carriage 4*a* to move in the main scanning direction A, a conveyance belt (not shown) by which the carriage 4*a* is moved under the state that the carriage 4*a* is supported, and a conveyance motor (not shown) that is a driving source for the carriage 4*a* to move. Incidentally, in this carriage mechanism portion 4, when the unillustrated conveyance motor is driven, the unillustrated conveyance belt operates, and the carriage 4*a* is moved in the main scanning direction A while it is guided by the guide member 4*b*. Incidentally, the direction for the carriage 4*a* to move is changed depending on the rotation direction of the unillustrated conveyance motor, thus, the carriage 4*a* conducts a back-and-forth motion in the main scanning direction A along the guide member 4*b*.

The maintenance unit 6 is a member provided at an end of movement of the carriage 4*a* as shown in FIGS. 1 and 2, and is provided with two suction caps 61 and 61 each covering the bottom surface of each jetting head 2 and drawing out ink staying on each jetting port 22 (see FIG. 3), collecting means 62 that collects ink drops jetted idle from each jetting head 2, wiper member 63 having cleaning wiper 66 that removes ink staying on the bottom surface of each jetting head 2, roughness value measuring portion 68 representing a roughness value measuring means that measures the state of surface roughness of the cleaning wiper 66, an elevator means (not shown) that makes the maintenance unit 6 itself to go up and down in the direction of arrow C and a moving means (not shown) that makes the maintenance unit 6 itself to move in the direction of arrow D (the direction identical to the main scanning direction A).

Two suction caps 61 and 61 are connected with suction pump 64. The suction pump 64 is one for generating suction with which two suction caps 61 and 61 draw out ink coming from each jetting head 2. Further, the suction pump 64 is connected to reservoir tank 65 that stores ink drawn out from jetting head 2. In short, the suction pump 64 is operated under the condition that the jetting plane 2*a* of jetting head 2 arranged on the two suction caps 61 and 61 is sealed hermetically by the suction caps 61, and thereby, ink remaining on each jetting port 22 of jetting head 2 is drawn out, and the drawn out ink can be reserved in the reservoir tank 65.

Wiper portion 63 is composed of cleaning wiper 66 representing a sheet-like elastic body that is provided so that it has a surface which is substantially vertical to the main scanning direction A and of supporting portion 67 that supports the cleaning wiper 66. One side of the surface which is substantially vertical to the main scanning direction A is contact surface 66*a* serving as a contact portion for rubbing jetting plane 2*a* of each jetting head 2 and thereby removing ink which remains on and sticks to jetting plane 2*a* as will be described later, and a length in the lateral direction (direction perpendicular to the main scanning direction) of the contact surface 66*a* is equal to or longer than a length of a width in the direction perpendicular to the main scanning direction A of jetting plane 2*a* of each jetting head 2.

Thus, ink sticking to jetting plane 2*a* of jetting head 2 is removed by the contact surface 66*a* of cleaning wiper 66.

In this case, cleaning wiper 66 of wiper member 63 satisfies the condition that a contact angle of ink sticking to the cleaning wiper 66 is not less than 50.5°, preferably, a backward dynamic contact angle is not less than 50.5°.

Further, the contact angle is angle θ (θ; contact angle) in the occasion where the following Young's expression (1) holds in a liquid drop formed on the surface of solid body.

$$\gamma_{SV}=\gamma_{SL}+\gamma_{LV}\cos\theta \quad (1)$$

$\gamma_{SV}$; Surface tension of a solid body $\gamma_{SL}$; Surface tension between a solid body and a liquid $\gamma_{LV}$; Surface tension of a liquid A backward dynamic contact angle is a name of a contact angle of the rear portion (upper portion) of a liquid drop at the moment when the liquid drop starts moving downward on the inclined surface of a solid body during the course of inclining the surface of the solid body gradually, under the condition that a liquid drop has been formed on the surface of a solid body, and a forward dynamic contact angle is a name of a contact angle of the front portion (lower portion) of a liquid drop.

Incidentally, with respect to measurement of the contact angle, all kinds of ink including four colors of Y, M, C and K were measured, and the smallest contact angle was designated as a contact angle. The contact angle is the backward dynamic contact angle stated above, and a value obtained through measurement by an expansion-contraction method employing automatic contact angle meter CA-V (made by KYOOWA KAIMENKAGAKU Co.) is used for the contact angle. For the measurement, an initial ink dripping amount at the start of measurement was prescribed to be 15 μl and a suction speed for an ink droplet was prescribed to be 5 μl/sec, and contact angle θ at the moment after 1.5 seconds from the start of suction was designated as the backward dynamic contact angle (contact angle).

As an elastic body constituting cleaning wiper 66 satisfying the condition that a contact angle of ink sticking to the cleaning wiper 66 is not less than 50.5°, preferably, a backward dynamic contact angle is not less than 50.5°, silicone rubber having high ink repellency (water repellency), for example, is appropriate. For example, a backward dynamic contact angle of MC-2000 exclusive ink MC1BK01 made by Epson Co. for silicone rubber IS-825 made by Irumagawa Rubber Co. is 57.0°, which satisfies the aforementioned condition that a contact angle (backward dynamic contact angle) of ink sticking to the cleaning wiper 66 (elastic body) is not less than 50.5°.

When this jetting plane 2*a* of jetting head 2 to which the ink is sticking is rubbed by cleaning wiper 66 made by silicone rubber whose backward dynamic contact angle is 57.0° at a speed of 90 mm/sec as a cleaning operation, ink that is removed from jetting plane 2*a* and is stuck to contact surface 66*a* of cleaning wiper 66 does not spread on the contact surface 66*a* and forms an elevated state on the contact surface 66*a*, as shown in FIG. 3. Due to this, ink does not leak through a slight clearance between jetting plane 2*a* and cleaning wiper 66 and is removed appropriately from jetting plane 2*a*. After this cleaning operation, the state of jetting plane 2*a* was confirmed, and ink sticking to the jetting plane 2*a* was not recognized.

In the same way, after the cleaning operation by cleaning wiper 66 whose backward dynamic contact angle is 50.5°, the state of the jetting plane 2*a* was confirmed, and ink sticking to the jetting plane 2*a* was not recognized.

On the other hand, after the cleaning operation wherein jetting plane 2*a* of jetting head 2 to which the ink is sticking was rubbed at a speed of 90 mm/sec by cleaning wiper 66 whose backward dynamic contact angle is 48.9° which is not more than 50.5°, the state of the jetting plane 2*a* was confirmed, and ink sticking to the jetting plane 2*a* was observed slightly. In the same way, after the cleaning operation by cleaning wiper 66 whose backward dynamic contact angle is 24.7°, the state of the jetting plane 2*a* was confirmed, and ink sticking to the jetting plane 2*a* was observed.

In short, the cleaning operation by cleaning wiper 66 whose backward dynamic contact angle is not more than 50.5° sometimes fails to remove ink from jetting plane 2*a* of jetting head 2 completely.

In the case of high wettability of ink for cleaning wiper 66 such as contact angle (backward dynamic contact angle) of not more than 50.5° of ink for cleaning wiper 66, when cleaning wiper 66 of wiper member 63 rubs for removing ink sticking to jetting plane 2*a* of jetting head 2, as a cleaning operation for jetting plane 2*a* of jetting head 2 as shown in FIG. 8, ink sometimes leaks through a slight clearance between the jetting plane 2*a* and cleaning wiper 66, because ink sticking to the contact surface 66*a* side tends to spread on the rear side in the direction of movement of cleaning wiper 66. In other words, ink remaining on and sticking to jetting plane 2*a* cannot be removed completely.

Thus, the condition as an elastic body constituting cleaning wiper 66 is that the contact angle (backward dynamic contact angle) with ink is 50.5° or more, because ink sticking to jetting plane 2*a* of jetting head 2 can be removed properly if the contact angle (backward dynamic contact angle) of ink sticking to the elastic body is 50.5° or more.

Figure 6:
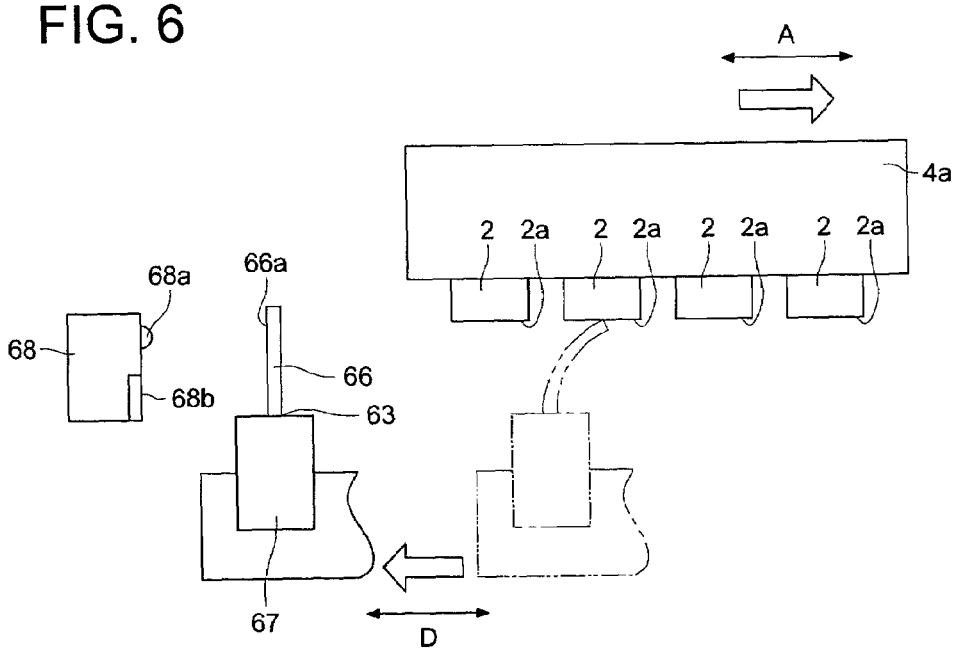
FIG. 6 is a side view showing how a contact surface of a wiper portion is measured by a roughness measuring portion.

As shown in FIG. 6, roughness value measuring portion 68 is a measuring portion for measuring a surface roughness of contact surface 66*a* of cleaning wiper 66, and for example, it is composed of light-emitting element 68*a* composed of LED and others and photo-detector element 68*b* which receives reflected light (received light) coming from contact surface 66*a* of cleaning wiper 66 based on emitted light outputted by the light-emitting element 68*a*.

The roughness value measuring portion 68 outputs emitted light in a prescribed amount from the light-emitting element 68*a*, and the photo-detector element 68*b* receives reflected light coming from contact surface 66*a* of cleaning wiper 66 based on the emitted light. For example, when the surface of contact surface 66*a* is smooth, an amount of light of received light based on reflected light is relatively large, while, when the surface of contact surface 66*a* is irregular with scratches and others, on the contrary, the reflected light is scattered on the surface, and an amount of light of received light based on reflected light received by the photo-detector element 68*b* is small. Data showing relationship between an amount of received light and surface roughness of contact surface 66*a* are stored and housed in ROM (not shown) of control section 5 which will be described later.

Now, correlation between surface roughness and a backward dynamic contact angle on contact surface 66*a* of cleaning wiper 66 will be explained.

Figure 4:
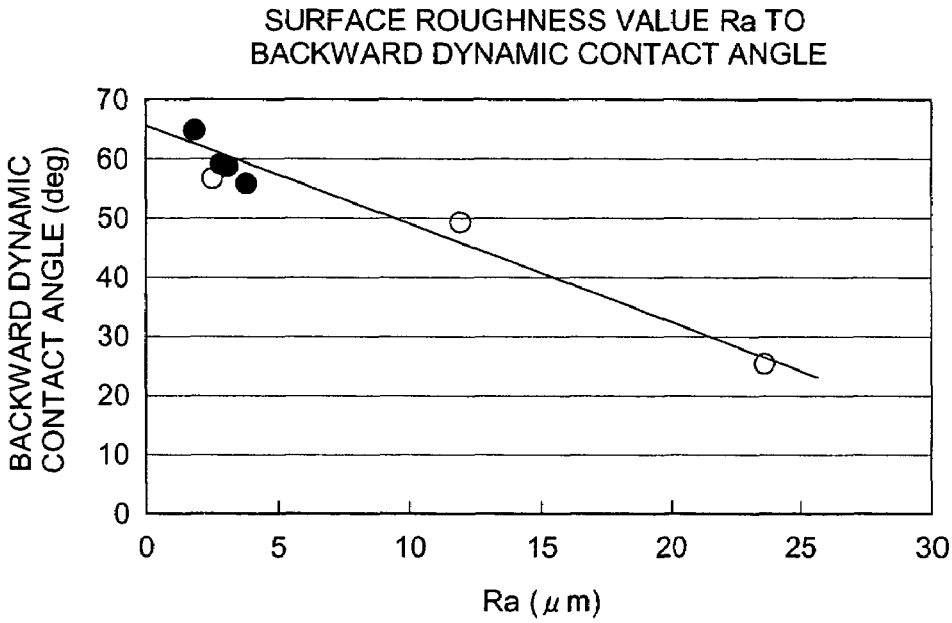
FIGS. 4(*a*) and 4(*b*) are graphs in which FIG. 4(*a*) is a graph showing relationship between a surface roughness value and a backward dynamic contact angle on a contact surface in a wiper portion, while, FIG. 4(*b*) is a graph showing relationship between the number of times of cleaning and a backward dynamic contact angle.
Figure 4:
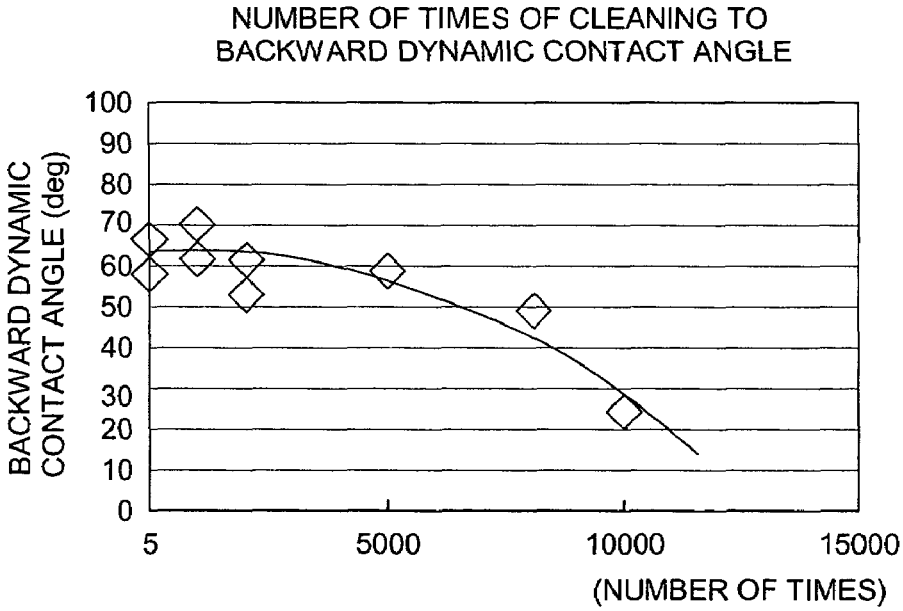

As shown by the correlation between a backward dynamic contact angle and a surface roughness value (Ra) showing roughness of contact surface 66*a* illustrated in FIG. 4(*a*), the backward dynamic contact angle becomes smaller as a value (Ra) of surface roughness of contact surface 66*a* grows greater. As shown by the correlation between a backward dynamic contact angle of ink for contact surface 66*a* of cleaning wiper 66 and the number of times of cleaning operated by cleaning wiper 66 (wiper member 63) illustrated in FIG. 4(*b*), the backward dynamic contact angle becomes smaller as the number of times of cleaning grows greater.

In other words, when a cleaning operation that contact surface 66*a* of cleaning wiper 66 removes ink sticking to jetting plane 2*a* of jetting head 2 is repeated, the contact surface 66*a* is damaged and worn out by friction with jetting plane 2*a*, which causes a trend that surface roughness (surface roughness value Ra) grows greater and a backward dynamic contact angle of ink for contact surface 66*a* becomes smaller.

The maintenance unit 6 having the structure mentioned above prevents generation of air bubbles and clogging on each jetting port 22 of each jetting head by the aforementioned two suction caps 61 and 61, collecting means 62 and by wiper member 63 (cleaning wiper 66), and further removes residual ink sticking to jetting plane 2*a*. Namely, owing to the maintenance unit 6, excellent state of jetting ink from jetting head 2 (jetting port 22) can be maintained, and clear images can be recorded on recording medium 99.

The control section 5 is composed schematically of CPU conducting various types of operations, ROM that stores and houses various types of programs for various processing such as control and judgment, conditions for various image recording operations, data of conditions for various maintenance operation processing, in particular, surface roughness value (Ra) data of contact surface 66*a* corresponding to an amount of light of reflected light (received light) from contact surface 66*a* of cleaning wiper 66 measured by roughness value measuring portion 68, and surface roughness value data for judgment established in advance representing a standard with which the contact surface 66*a* of cleaning wiper 66 can clean jetting plane 2*a* of jetting head 2 properly, and of RAM that is used as work memory in various types of processing.

Incidentally, the surface roughness value for judgment representing a standard with which the jetting plane 2*a* of jetting head 2 can be cleaned properly is, for example, a surface roughness in the occasion where the contact angle (backward dynamic contact angle) of ink for contact surface 66*a* of cleaning wiper 66 is 50.5°.

This control section 5 controls to calculate a surface roughness value (Ra) of contact surface 66*a* based on an amount of light of reflected light (received light) from contact surface 66*a* of cleaning wiper 66 based on emitted light measured by roughness value measuring portion 68 and outputted by light-emitting element 68*a*.

Further, the control section 5 compares a surface roughness value calculated with a surface roughness value for judgment stored in ROM of the control section 5 as a judgment means, and controls to judge whether the calculated surface roughness value is greater than the surface roughness value for judgment or not.

Further, when the judgment means judges that the calculated surface roughness value is greater than the surface roughness value for judgment, the control section 5 controls, as a warning means, to warn that the contact angle of ink on contact surface 66*a* of cleaning wiper 66 is not more than the prescribed value. Incidentally, this warning is conducted, as a prescribed output format, by warning indication on an unillustrated display portion, by transmission of warning sound in an unillustrated alarm portion, or by warning lighting in an unillustrated lighting portion.

As a second example, CPU that conducts various types of operations, ROM that stores various types of programs for various processing such as control and judgment, conditions for various image recording operations and data of various processing conditions for maintenance operations and a nonvolatile memory storage that stores variable data (which are not shown), are connected to the control section 5. In addition to various types of programs, there are stored data which are measured in advance and a table prepared by a backward dynamic contact angle versus the number of times of cleaning, in areas in ROM. The nonvolatile memory storage that stores variable data is made to store the number of times of maintenance operations. The CPU is structured to operate as each means stated below, by operating in accordance with the aforementioned programs.

After completion of cleaning operations, the control section 5 downloads the nonvolatile memory storage to count up data in a prescribed memory, and then, uploads the data to the nonvolatile memory storage so that the number of times of maintenance operations carried out may be stored in the main body of the apparatus. It is possible to obtain a backward dynamic contact angle after the maintenance operation based on the number of times of the maintenance operations stated above, by using the table of a backward dynamic contact angle versus the number of times of cleaning. Then, the backward dynamic contact angle obtained through calculation is compared with a backward dynamic contact angle for judgment stored in ROM, to judge whether the calculated backward dynamic contact angle is greater than the backward dynamic contact angle (50.5°) for judgment or not, for control purposes.

Further, in addition to the table used for the backward dynamic contact angle versus the number of times of cleaning, it is also possible to perform control functions wherein an approximate expression of table data is prepared, a backward dynamic contact angle is calculated based on the number of times of maintenance operations by using the approximate expression, and the calculated backward dynamic contact angle is compared with the backward dynamic contact angle (50.5°) for judgment to form a judgment.

When the judgment means judges that the calculated backward dynamic contact angle is greater than the (50.5°) for judgment, the control section 5 controls, as a warning function, to warn that the contact angle of ink on contact surface 66*a* of cleaning wiper 66 is not more than the prescribed value. Incidentally, this warning is conducted, as a prescribed output format, by warning indication on an unillustrated display portion, by transmission of warning sound in an unillustrated alarm portion, or by warning lighting in an unillustrated lighting portion.

Further, it is also possible for the control section 5 to make a value obtained by subtracting the value of the backward dynamic contact angle (50.5°) for judgment from the backward dynamic contact angle calculated by the judgment means to be indications for the residue of a blade on an unillustrated display portion.

After the cleaning wiper 66 is replaced by a user after the user is warned by the warning means, the value of the counted data in the memory is naturally returned to the initial value (0).

In ink jet printer 1 of this kind, jetting head 2 is maintained by maintenance unit 6 each time images in prescribed number are recorded. To be concrete, when recording of images in prescribed number is completed, carriage 4*a* moves from recording area I to non-recording area II (see FIG. 2) and stops there. Incidentally, in this case, wiper member 63 (cleaning wiper 66) and roughness value measuring portion 68 are at their descended positions so that they may not interfere with movement of each jetting head 2.

Then, maintenance unit 6 is moved in the direction of arrow D by a moving means (not shown) so that two suction caps 61 and 61 of the maintenance unit 6 may face two jetting heads 2 and 2 on the edge among four jetting heads 2. At this position, the maintenance unit 6 is elevated in the direction of arrow C by an elevating means (not shown). In this way, two suction caps 61 and 61 cover jetting plane 2*a* of two jetting heads 2 and 2, and after that, suction of ink from these two jetting heads are conducted simultaneously. After the suction of ink are completed, suction of ink from remaining two jetting heads 2 and 2 are conducted in the same way.

Then, the maintenance unit 6 is moved in the direction of arrow D by a moving means (not shown) so that cleaning wiper 66 of wiper member 63 may be located at a position that is slightly shifted from the position where the cleaning wiper 66 of wiper member 63 faces jetting head 2 (carriage 4*a*). After the maintenance unit 6 arrives at the desired position, the maintenance unit 6 is elevated by an elevating means (not shown) in the direction of arrow C. In this case, an upper end portion of cleaning wiper 66 of wiper member 63 is protruded to the position that is higher than jetting plane 2*a* of each jetting head 2.

Figure 5:
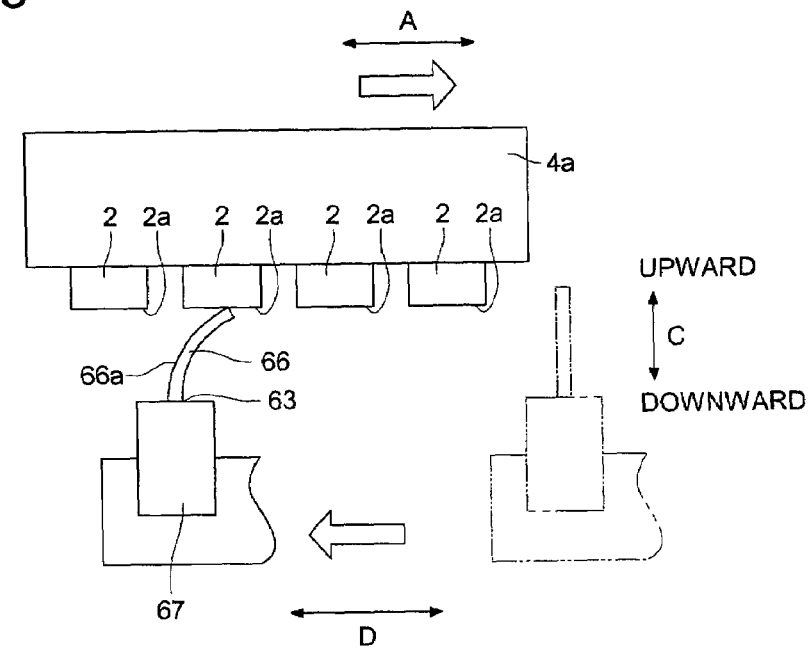
FIG. 5 is a side view showing how a jetting plane of a jetting head is cleaned by a wiper portion.

Then, in the state shown in FIG. 5, the maintenance unit 6 is moved in the direction of arrow D to the left side in the drawing by an elevating means (not shown), and an edge in the forefront of cleaning wiper 66 of wiper member 63 comes in contact with jetting plane 2*a* of each jetting head 2. Further, with a movement of the maintenance unit 6, cleaning wiper 66 of wiper member 63 is deformed elastically and contact surface 66*a* of cleaning wiper 66 moves to rub jetting plane 2*a* of each jetting head 2, as shown in FIG. 5. Due to this, ink sticking to jetting plane 2*a* of each jetting head 2 is removed by cleaning wiper 66.

Incidentally, in this case, it is also possible to arrange, as a second moving means, so that carriage 4*a* of carriage mechanism portion 4 moves toward the right side in the drawing in the direction of arrow A to make contact surface 66*a* of cleaning wiper 66 to rub jetting plane 2*a* of each jetting head 2.

Since a contact angle (backward dynamic contact angle) of ink for cleaning wiper 66 is 50.5° or more in this case, ink does not leak through a slight clearance between jetting plane 2*a* and cleaning wiper 66, and ink sticking to jetting plane 2*a* can be removed satisfactorily, when cleaning wiper 66 of wiper member 63 rubs to remove ink staying on jetting plane 2*a* of each jetting head 2.

Next, irregularities on the surface of contact surface 66*a* of cleaning wiper 66 and the state of roughness are measured by roughness value measuring portion 68 as shown in FIG. 6.

First, the roughness value measuring portion 68 outputs emitted light from light-emitting element 68*a* to illuminate contact surface 66*a* of cleaning wiper 66. Then, the roughness value measuring portion 68 outputs to control section 5 data signals based on an amount of light of received light received by photo-detector element 68*b* among reflected light representing the aforesaid emitted light reflected on the contact surface 66*a*.

The control section 5 calculates surface roughness value (Ra) of contact surface 66*a* based on data signals relating to an amount of light of received light coming from the roughness value measuring portion 68, and compares the calculated surface roughness value with the surface roughness value for judgment stored beforehand in ROM of the control section 5, as a judgment means. When the control section 5 judges the calculated surface roughness value to be smaller than the surface roughness value for judgment, the contact surface 66*a* of cleaning wiper 66 is considered to be in good conditions, and recording operations of ink jet printer 1 are continued as they are.

On the other hand, when the control section 5 judges the calculated surface roughness value to be greater than the surface roughness value for judgment, the control section 5 warns that the contact angle of ink on contact surface 66*a* of cleaning wiper 66 is not more than a prescribed value, through a prescribed output format. After that, replacement of cleaning wiper 66 of wiper member 63 is conducted, and recording operations of ink jet printer 1 are continued while the warning is continued, until the state of warning is released.

Incidentally, when cleaning of jetting plane 2*a* of jetting head 2 by wiper member 63 is completed, an elevating means (not shown) makes the maintenance unit 6 to descend in the direction of arrow C.

After that, the maintenance unit 6 is moved by a moving means (not shown) in the direction of arrow D so that collecting means 62 of the maintenance unit 6 may be gradually positioned directly under each jetting head 2, and the maintenance unit 6 is elevated by an elevating means (not shown) in the direction of arrow C, and ink is jetted idle to collecting means 62 from jetting head 2 that faces the collecting means 62.

Then, when jetting idle is completed for all jetting heads 2, maintenance of each jetting head 2 by the maintenance unit 6 is completed. After maintenance of each jetting head 2 is completed, carriage 4*a* moves from non-recording area II to the inside of recording area I so that recording operations may be resumed.

As stated above, if the contact angle (backward dynamic contact angle) between ink and cleaning wiper 66 of wiper member 63 removing ink sticking to jetting plane 2*a* of jetting head 2 equipped on carriage 4*a* of ink jet printer 1 is 50.5° or more, ink does not remain on jetting plane 2*a* and can be removed satisfactorily. Owing to that, jetting of ink on jetting head 2 is conducted properly, and an operation of each of carriage 4*a* and ink jet printer 1 can be conducted satisfactorily.

Incidentally, the invention is not limited to the aforementioned embodiment, and various improvements and various design changes may be made within a scope that does not deviate from the spirit and main points of the invention. For example, it is also possible to employ the structure wherein wiper member 63 moves individually and independently, although the embodiment employs the structure wherein the whole of maintenance unit 6 moves in the case of maintenance.

Further, when cleaning the jetting plane 2*a* of jetting head 2 with cleaning wiper 66 of wiper member 63, either one of the jetting head 2 and the wiper member 63 has only to move to approach the other relatively, and therefore, either one of carriage 4*a* of carriage mechanism portion 4 that moves the jetting head 2 and a moving means (not shown) that moves the wiper member 63 (maintenance unit 6) may be moved, or both of them may be moved simultaneously in the structure. Further, the direction of that movement is not limited to the main scanning direction A representing the moving direction of carriage 4*a*, and the structure wherein the movement in the direction perpendicular to the main scanning direction A is made to clean the jetting plane 2*a* may also be employed.

Further, when the warning means warns that the contact angle of ink on contact surface 66*a* of cleaning wiper 66 is not more than a prescribed value, through a prescribed output format, it is also possible to stop recording operations of ink jet printer 1 temporarily after the prescribed warning, although it has been described earlier that replacement of cleaning wiper 66 of wiper member 63 is conducted, and recording operations of ink jet printer 1 are continued until the state of warning is released.

Further, although there has been illustrated earlier that cleaning of jetting plane 2*a* of each jetting head 2 by cleaning wiper 66 of wiper member 63 is conducted before jetting ink idle to collecting means 62, the structure to clean jetting plane 2*a* of each jetting head 2 by wiper member 63 after jetting ink idle may also be employed.

Further, a number for each of jetting head 2, sub-tank 3, main tank 8 and pressure pump 9 is optional.

In addition, a number for wiper member 63 of maintenance unit 6 is optional, and the structure to provide wiper member 63 on each jetting head 2 may also be employed. A number for each of suction cap 61 and collecting means 62 is naturally optional.

Though an example wherein a liquid jetting apparatus is applied to an ink jet printer that jets ink has been explained in the aforesaid embodiment, the invention is not limited to this, and it is free to apply the invention to any apparatus, provided that the apparatus is one to jet liquid to record and form images and image-shaped patterns.

In addition, any changes may naturally be made for other detailed structures in a concrete form.

In the invention according to Structure (1), jetted liquid to be removed by a cleaning wiper does not spread its liquid surface on the surface of the cleaning wiper, and can be removed from a jetting plane of a jetting head properly by the cleaning wiper, because a contact angle formed between a cleaning wiper of a jetting head for removing jetted liquid sticking to a jetting plane of a jetting head is 50.5° or more. Therefore, the jetted liquid does not remain on the jetting plane of the jetting head, and jetted liquid sticking to the jetting plane of the jetting head can be removed.

In the invention according to Structure (2), the same effect as in the invention according to Structure (1) can naturally be obtained, and in particular, jetted liquid to be removed by a cleaning wiper does not spread its liquid surface on the rear portion in a movement of the cleaning wiper in cleaning operation, and can be removed from a jetting plane of a jetting head properly by the cleaning wiper, because a backward dynamic contact angle formed between a cleaning wiper of a jetting head for removing jetted liquid sticking to a jetting plane of a jetting head is 50.5° or more. Therefore, the jetted liquid does not remain on the jetting plane of the jetting head, and jetted liquid sticking to the jetting plane of the jetting head can be removed.

In the invention according to Structure (3), it is possible to warn promptly that the surface roughness value of the contact portion has become greater than the surface roughness value for judgment, because the warning means warns in a prescribed output format when the surface roughness value of the contact portion of the wiper for cleaning measured by the roughness measuring means is judged to be greater than the surface roughness value for judgment established in advance by the judging means.

In other words, deterioration of the wiper that the surface roughness value of the contact portion has become greater than the surface roughness value for judgment established as a threshold value in advance can be warned promptly, and appropriate actions can be taken based on what has been warned.

What is claimed is:

1. An ink jet printer comprising:

(a) a jetting head having a jetting plane on which a jetting port for jetting liquid to be jetted is provided;

(b) a cleaning wiper having a blade for rubbing the jetting plane of the jetting head to remove jetted liquid sticking to the jetting plane; and (c) a controller for warning a user of deterioration of the cleaning wiper for the jetting plane, wherein a backward dynamic contact angle of present time is estimated based on number of times of conducted maintenance operations by reference to data with respect to the number of times of maintenance operations versus backward dynamic contact angles which have been obtained through measurement in advance, and the controller warns the user of time of replacement for the cleaning wiper when the backward dynamic contact angle comes to a prescribed value or lower.

2. The ink jet printer of claim 1, wherein the backward dynamic contact angle formed between the cleaning wiper and jetted liquid is 50.5° or more.

3. An ink jet printer comprising:

(a) a jetting head having a jetting plane on which a jetting port for jetting liquid to be jetted is provided;

(b) a cleaning wiper having a blade for rubbing the jetting plane of the jetting head to remove jetted liquid sticking to the jetting plane; and (c) a controller for warning a user of deterioration of the cleaning wiper for the jetting plane, further comprising a measuring device for measuring a backward dynamic contact angle of a contact portion at the cleaning wiper that comes in contact with the liquid jetting plane, wherein the controller warns in a prescribed output form when the controller judges that the backward dynamic contact angle of the contact portion measured by the measuring device is greater than the backward dynamic contact angle for judgment established in advance.

4. The ink jet printer of claim 3, wherein the backward dynamic contact angle formed between the cleaning wiper and jetted liquid is 50.5° or more.

* * * * *